US008779986B2

(12) United States Patent
Fan et al.

(10) Patent No.: US 8,779,986 B2
(45) Date of Patent: Jul. 15, 2014

(54) WIDEBAND ANTENNA

(75) Inventors: Wen-Chuan Fan, Hsinchu (TW); Yi-Feng Wu, Hsinchu (TW); Wei-Hung Ruan, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 202 days.

(21) Appl. No.: 13/253,990

(22) Filed: Oct. 6, 2011

(65) Prior Publication Data

US 2013/0021209 A1 Jan. 24, 2013

(30) Foreign Application Priority Data

Jul. 20, 2011 (TW) ..... 100125591 A

(51) Int. Cl.
*H01Q 5/00* (2006.01)
*H01Q 9/40* (2006.01)
*H01Q 9/42* (2006.01)

(52) U.S. Cl.
CPC ..... *H01Q 9/42* (2013.01); *H01Q 5/0058* (2013.01)
USPC ..... 343/700 MS

(58) Field of Classification Search
CPC ..... H01Q 5/00; H01Q 5/0024; H01Q 5/0027; H01Q 5/0062; H01Q 5/0065; H01Q 5/0068; H01Q 5/0072
USPC ..... 343/700 MS, 702
See application file for complete search history.

(56) References Cited

U.S. PATENT DOCUMENTS

| | | | | |
|---|---|---|---|---|
| 6,611,235 | B2 * | 8/2003 | Barna et al. | 343/702 |
| 7,136,019 | B2 * | 11/2006 | Mikkola et al. | 343/702 |
| 7,345,637 | B2 * | 3/2008 | Mizoguchi et al. | 343/702 |
| 7,825,863 | B2 * | 11/2010 | Martiskainen et al. | 343/702 |
| 8,134,517 | B2 * | 3/2012 | Wang et al. | 343/846 |
| 2002/0149527 | A1 * | 10/2002 | Wen et al. | 343/727 |
| 2010/0117909 | A1 * | 5/2010 | DeJean | 343/702 |

* cited by examiner

*Primary Examiner* — Hoang V Nguyen
*Assistant Examiner* — Patrick Holecek
(74) *Attorney, Agent, or Firm* — Winston Hsu; Scott Margo

(57) ABSTRACT

A wideband antenna includes a grounding element; a feed-in terminal; a first radiating unit, electrically connected to the feed-in terminal and extending from the feed-in terminal toward a first direction; a second radiating unit, electrically connected to the feed-in terminal, extending from the feed-in terminal toward a second direction, and including a meander-shaped element; and a third radiating unit, electrically connected to the grounding element, extending from the grounding element toward the first radiating unit and the second radiating unit, and having one segment parallel to the meander-shaped element, for coupling the meander-shaped element.

7 Claims, 9 Drawing Sheets

WIDEBAND ANTENNA

BACKGROUND OF THE INVENTION

1. Field of the Invention

The present invention relates to a wideband antenna, and more particularly, to a wideband antenna using a meander-shaped radiating unit and a coupling method to increase operating bandwidth and maintain antenna efficiency.

2. Description of the Prior Art

Antennas are utilized for emitting or receiving radio waves, so as to transmit or exchange wireless signals. As the wireless communication technology progresses, operating bands of wireless communication systems become wider; for example, Long Term Evolution, LTE, system requires operating bands from 704 MHz to 960 MHz and from 1710 MHz to 2700 MHz. In such a situation, how to effectively increase antenna bandwidth, and meanwhile, decrease antenna dimension has become a goal in the industry.

SUMMARY OF THE INVENTION

A wideband antenna capable of increasing antenna bandwidth is disclosed. The wideband antenna comprises a grounding element; a feed-in terminal; a first radiating unit, electrically connected to the feed-in terminal and extending from the feed-in terminal toward a first direction; a second radiating unit, electrically connected to the feed-in terminal, extending from the feed-in terminal toward a second direction, and comprising a meander-shaped element; and a third radiating unit, electrically connected to the grounding element, extending from the grounding element toward the first radiating unit and the second radiating unit, and having one segment parallel to the meander-shaped element, for coupling the meander-shaped element.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
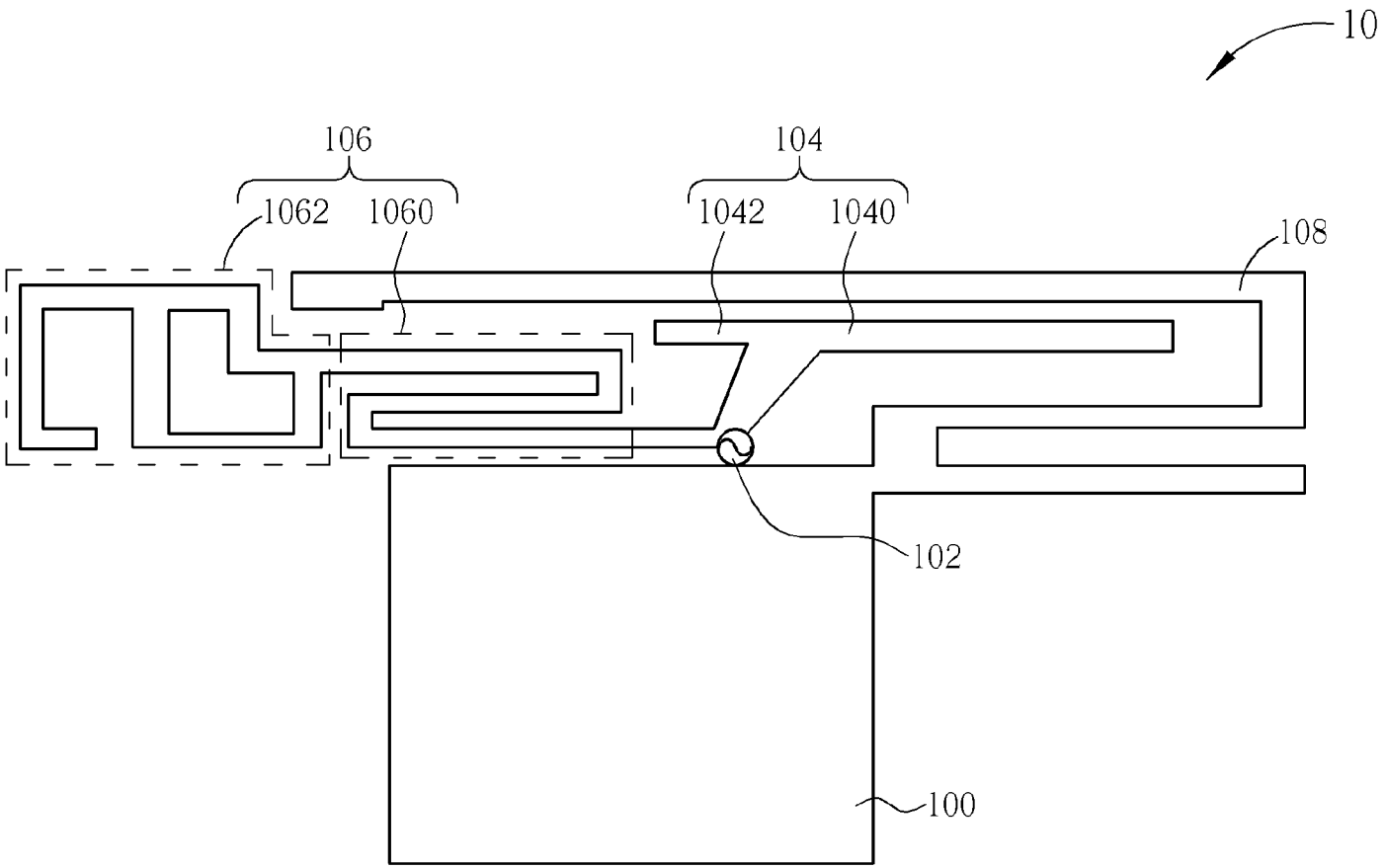
FIG. 1 is a schematic diagram of a wideband antenna according to an embodiment of the present invention.

Please refer to FIG. 1, which is a schematic diagram of a wideband antenna 10 according to an embodiment of the present invention. The wideband antenna 10 is suitable for wireless communication systems having wideband operation requirements, such as LTE system. The wideband antenna 10 includes a grounding element 100, a feed-in terminal 102, a first radiating unit 104, a second radiating unit 106 and a third radiating unit 108. The grounding element 100 is connected to a system ground, for providing grounding. The feed-in terminal 102 is utilized for transmitting radio-frequency (RF) signals, so as to receive or transmit radio waves through the first radiating unit 104, the second radiating unit 106 and the third radiating unit 108. The first radiating unit 104 and the second radiating unit 106 are electrically connected to the feed-in terminal 102, and extend from the feed-in terminal 102 toward a right-side direction and a left-side direction of FIG. 1, respectively. The first radiating unit 104 includes segments 1040 and 1042, for receiving and transmitting wireless signals of (relatively) high frequencies, while the second radiating unit 106 includes a meander-shaped element 1060 and an auxiliary radiating unit 1062, for receiving and transmitting wireless signals of (relatively) low frequencies. In addition, the third radiating unit 108 is electrically connected to the grounding element 100, substantially surrounds the first radiating unit 104, and is parallel to the first radiating unit 104 and the meander-shaped element 1060 of the second radiating unit 106.

Figure 2:
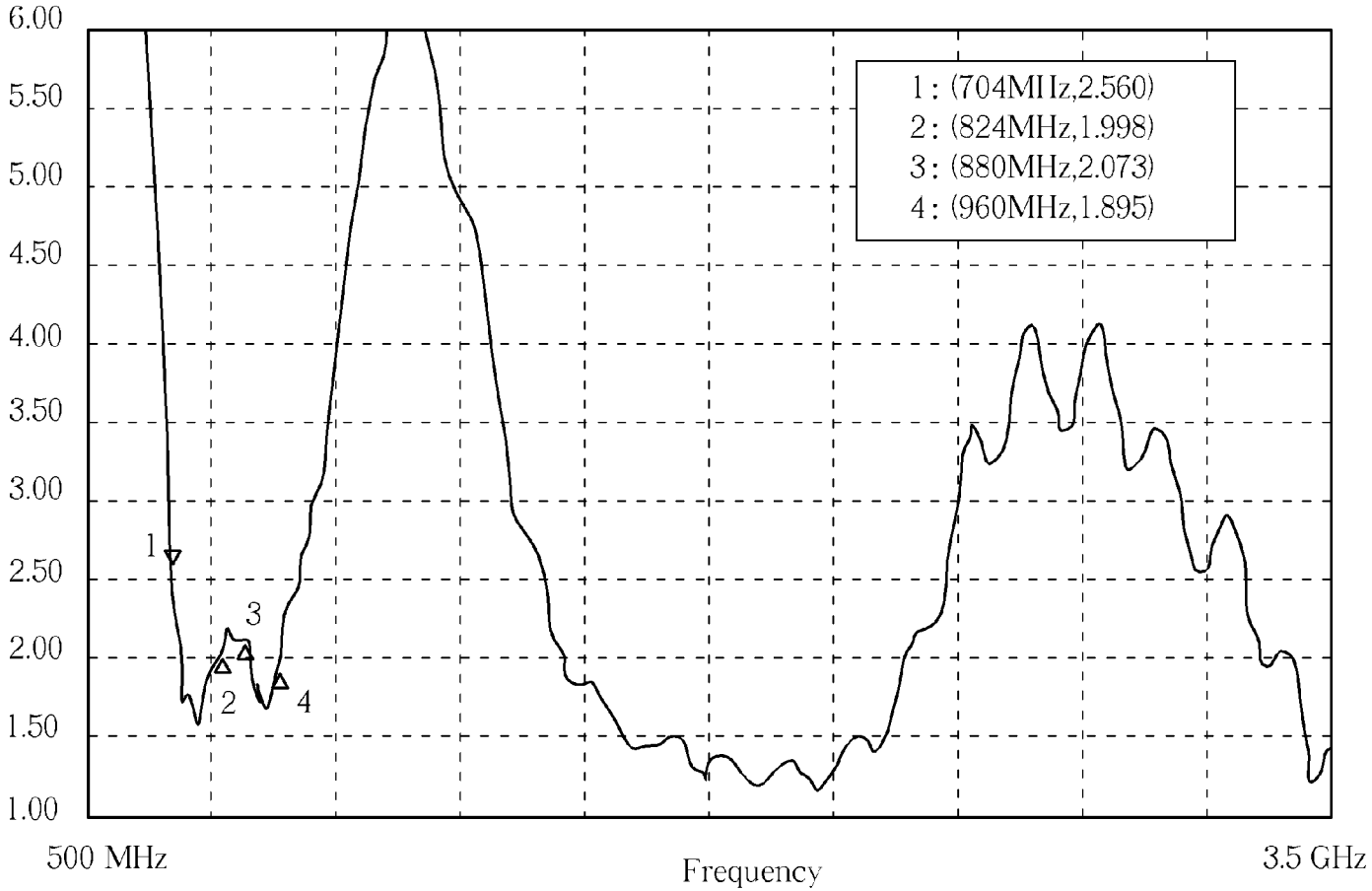
FIG. 2 is a schematic diagram of voltage standing wave ratio (VSWR) of the wideband antenna shown in FIG. 1.
Figure 3:
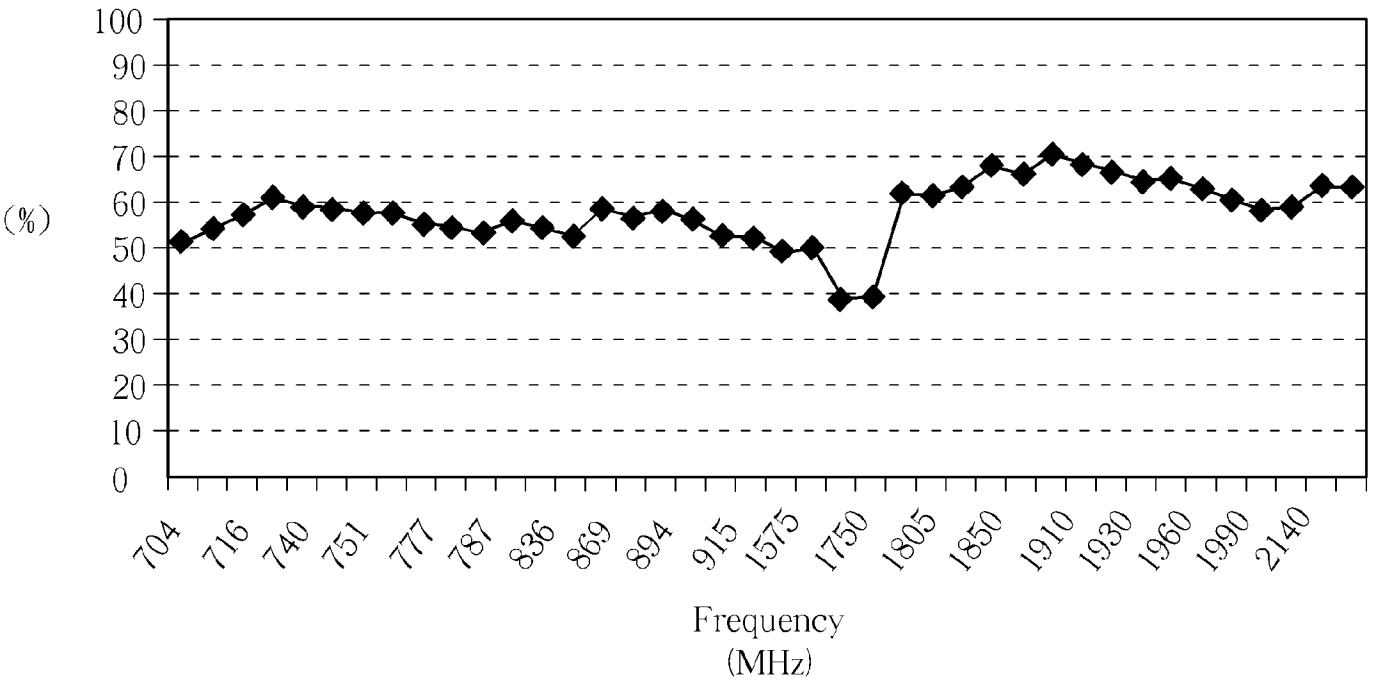
FIG. 3 is a schematic diagram of antenna efficiency of the wideband antenna shown in FIG. 1.

In detail, the wideband antenna 10 can resonate to generate at least two high-frequency bands and two low-frequency bands. A high-frequency band is obtained via resonating of the first radiating unit 104, and a low-frequency band is obtained via resonating of the second radiating unit 106. Furthermore, the meander-shaped element 1060 includes a segment coupled to the grounding element 100, and another segment coupled to the third radiating unit 108; thus, the third radiating unit 108 resonates to generate another low-frequency band, and the meander-shaped element 1060 resonates to generate another high-frequency band. Meanwhile, the auxiliary radiating unit 1062 is utilized for further increasing bandwidth. Therefore, after properly adjusting the wideband antenna 10, the wideband antenna 10 can be suitable for LTE system, and obtain a schematic diagram of voltage standing wave ratio (VSWR) as shown in FIG. 2 and a schematic diagram of antenna efficiency as shown in FIG. 3. In FIG. 2, a band between 704 MHz and 824 MHz is added because the meander-shaped element 1060 couples the third radiating unit 108.

In short, the third radiating unit 108 generates coupling effects with both the first radiating unit 104 and the meander-shaped element 1060, and a segment of the meander-shaped element 1060 couples the grounding element 100, such that the third radiating unit 108 resonates to obtain the low-frequency band, while the meander-shaped element 1060 resonates to obtain the high-frequency band.

Noticeably, the wideband antenna 10 shown in FIG. 1 is an embodiment of the present invention, for illustrating that with the meander-shaped element 1060 of the second radiating unit 106 and the coupling method of the third radiating unit 108, the operating bandwidth of the wideband antenna 10 can be increased and the antenna efficiency can be maintained. However, those skilled in the art can make modifications or alternations accordingly. For example, components of the wideband antenna 10 can be fixed by any proper methods. For example, the components of the wideband antenna 10 can be formed on a substrate, or fixed by insulating materials. In addition, in FIG. 1, the meander-shaped element 1060 is composed of three segments, which conforms to the LTE system, but is not limited thereto, as long as the meander-shaped element 1060 can generate coupling effects with both the grounding element 100 and the third radiating unit 108.

Similarly, the auxiliary radiating unit 1062 is utilized for increasing the bandwidth of the wideband antenna 10, and may be removed from the wideband antenna 10, or have different shapes in comparison to the embodiment of FIG. 1. Besides, as those skilled in the art recognized, operating frequencies of an antenna are related to current routes within the antenna; thus, a designer should properly adjust the dimension, material, etc. of the wideband antenna 10, or add matching units to the wideband antenna 10 according to required operating frequencies.

Figure 4:
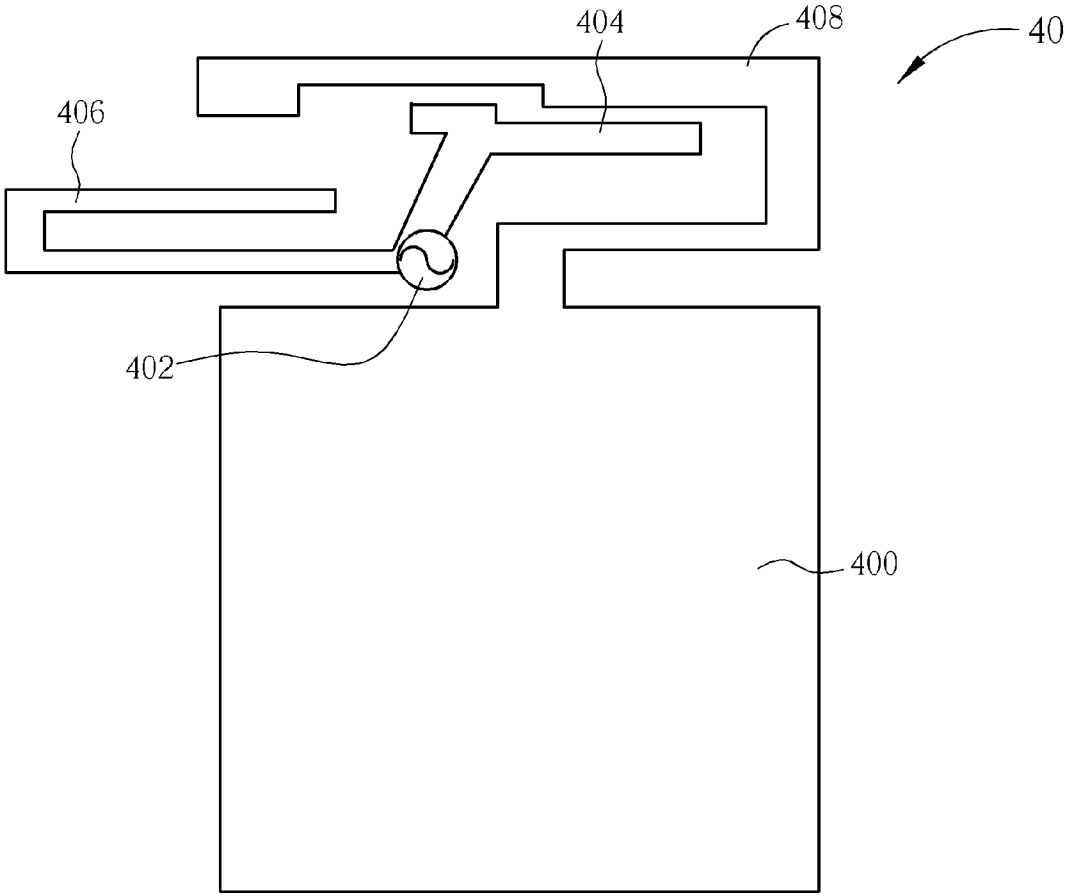
FIG. 4 is a schematic diagram of a wideband antenna according to an embodiment of the present invention.
Figure 5:
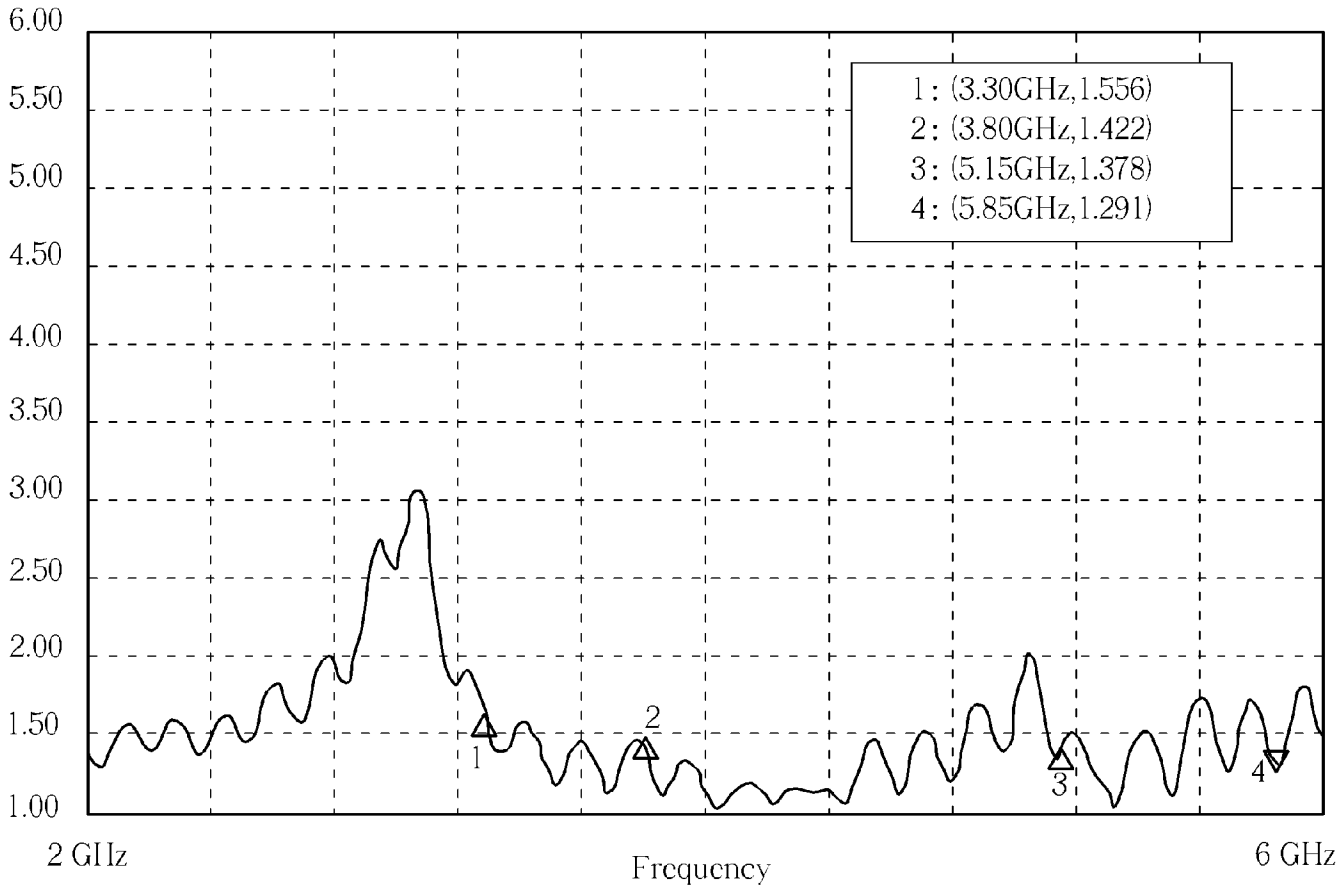
FIG. 5 is a schematic diagram of voltage standing wave ratio (VSWR) of the wideband antenna shown in FIG. 4.
Figure 6:
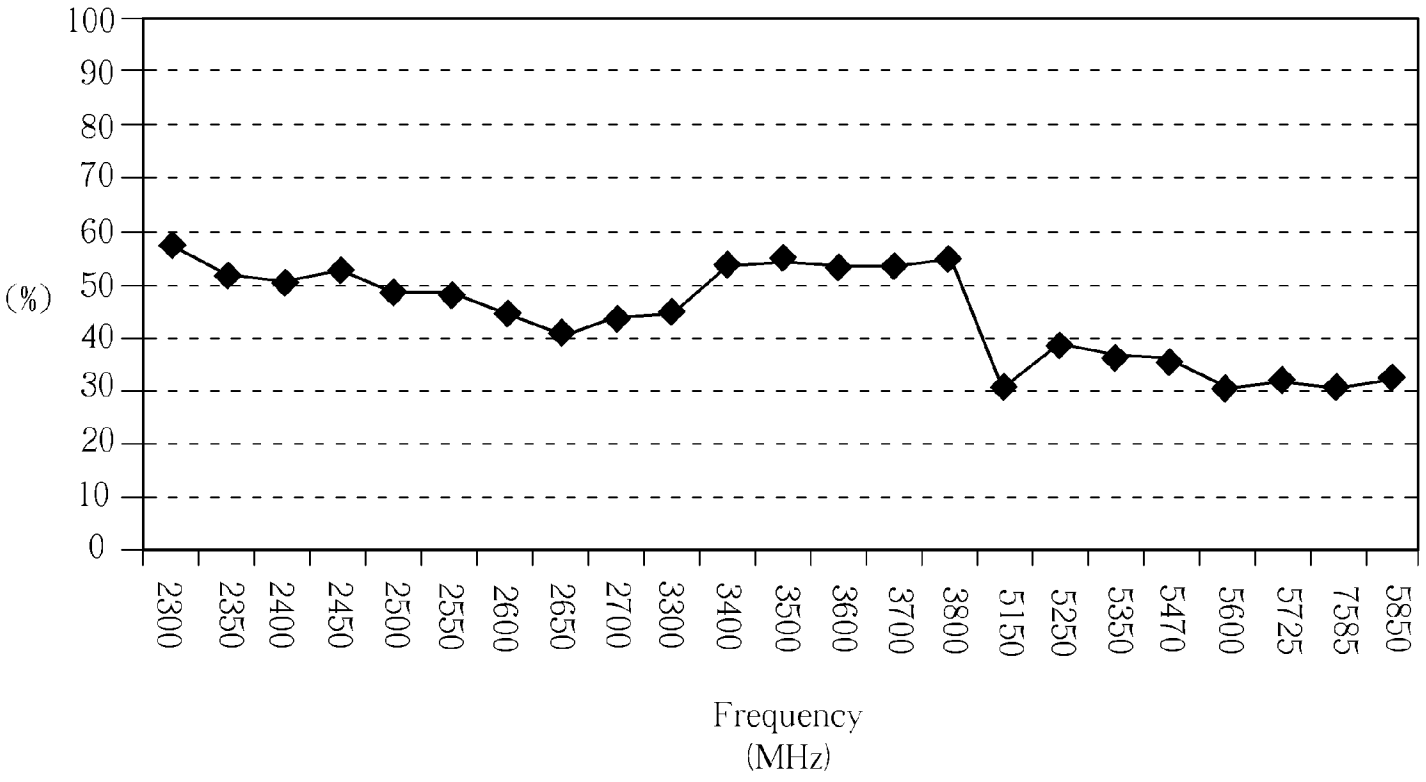
FIG. 6 is a schematic diagram of antenna efficiency of the wideband antenna shown in FIG. 4.

For example, please refer to FIG. 4, which illustrates a schematic diagram of a wideband antenna 40 according to an embodiment of the present invention. The wideband antenna 40 is suitable for wireless communication systems, such as Wimax system, and includes a grounding element 400, a feed-in terminal 402, a first radiating unit 404, a second radiating unit 406 and a third radiating unit 408. Comparing FIG. 4 and FIG. 1, the structure and operating principle of the wideband antenna 40 are similar to those of the wideband antenna 10; that is, a first radiating unit 404 resonate to generate a high-frequency band, and a second radiating unit 406 resonates to generate a low-frequency band; meanwhile, a third radiating unit 408 generates coupling effects with both a first radiating unit 404 and a second radiating unit 406, and the second radiating unit 406 couples a grounding element 400, such that the third radiating unit 408 resonates to obtain another low-frequency band, while the second radiating unit 406 resonates to obtain another high-frequency band. The difference between the wideband antenna 40 and the wideband antenna 10 is a meander-shaped element of the second radiating unit 406 includes two segments to conform to band requirements of Wimax system, and does not include a structure of the auxiliary radiating unit 1062; or the second radiating unit 406 can be seen as a combination of the meander-shaped element and the auxiliary radiating unit. Therefore, please continue to refer to FIG. 5 and FIG. 6, which are respectively a VSWR diagram and an antenna efficiency diagram of the wideband antenna 40. As can be seen, the wideband antenna 40 features wideband and good antenna efficiency.

Figure 7:
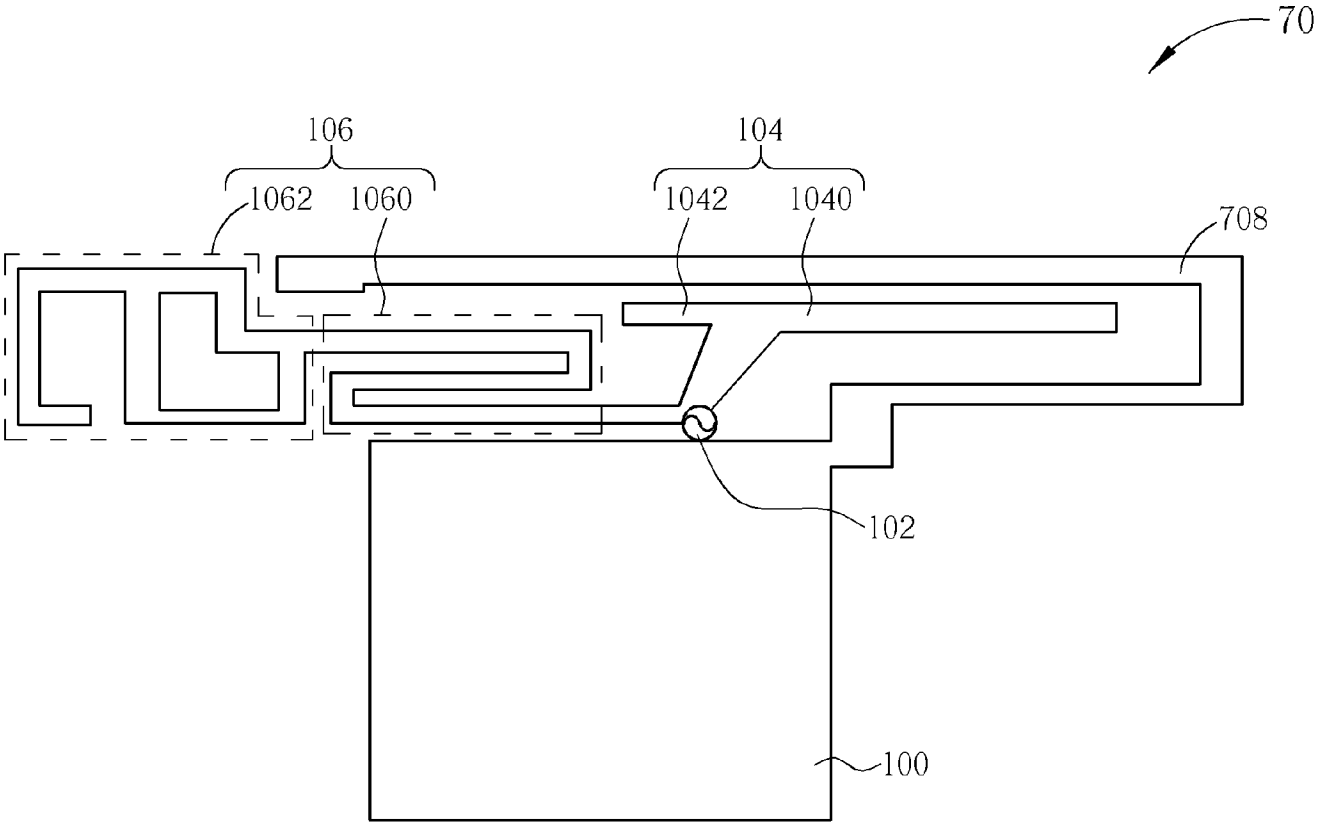
FIG. 7 is a schematic diagram of a wideband antenna according to an embodiment of the present invention.
Figure 8:
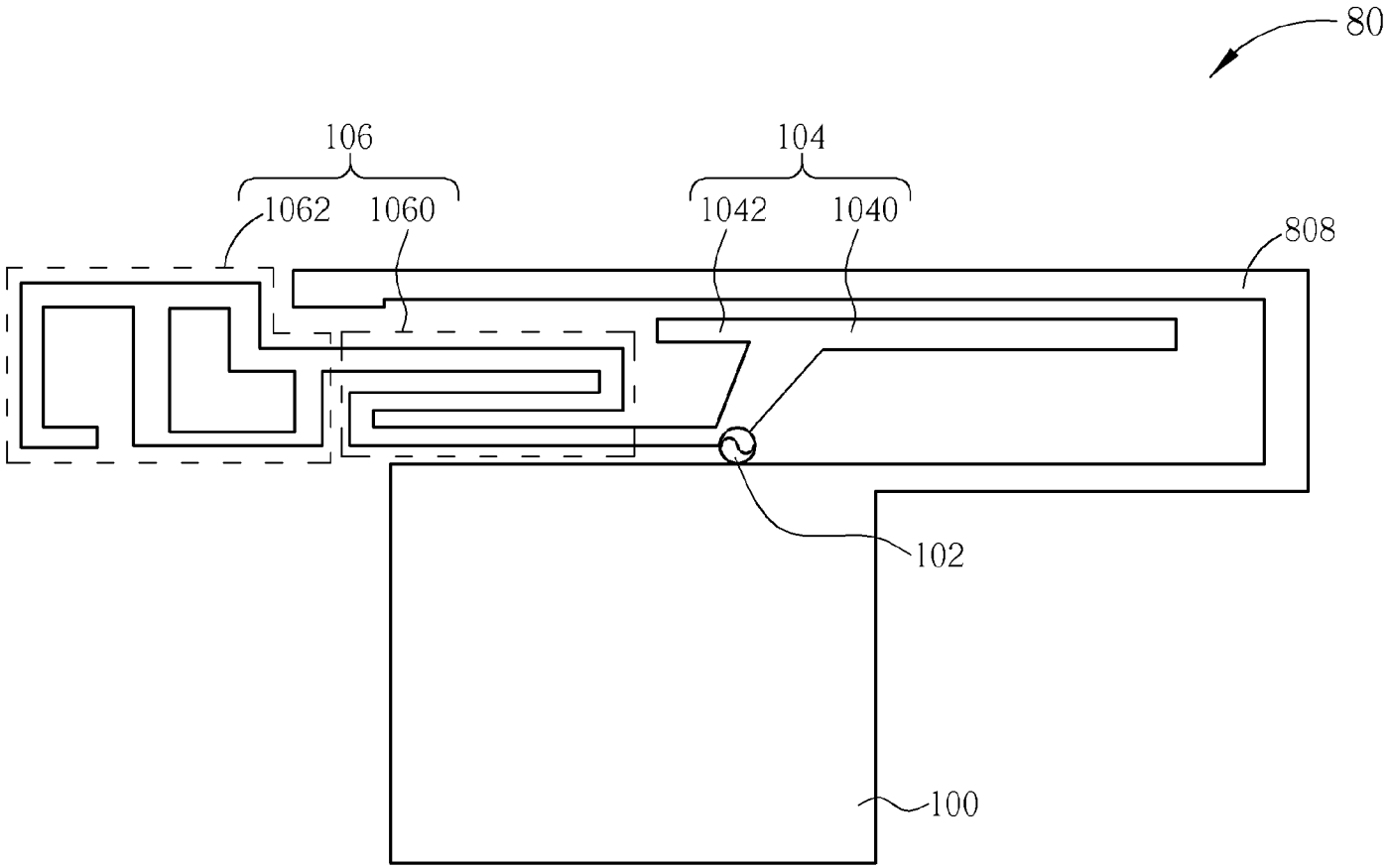
FIG. 8 is a schematic diagram of a wideband antenna according to an embodiment of the present invention.
Figure 9:
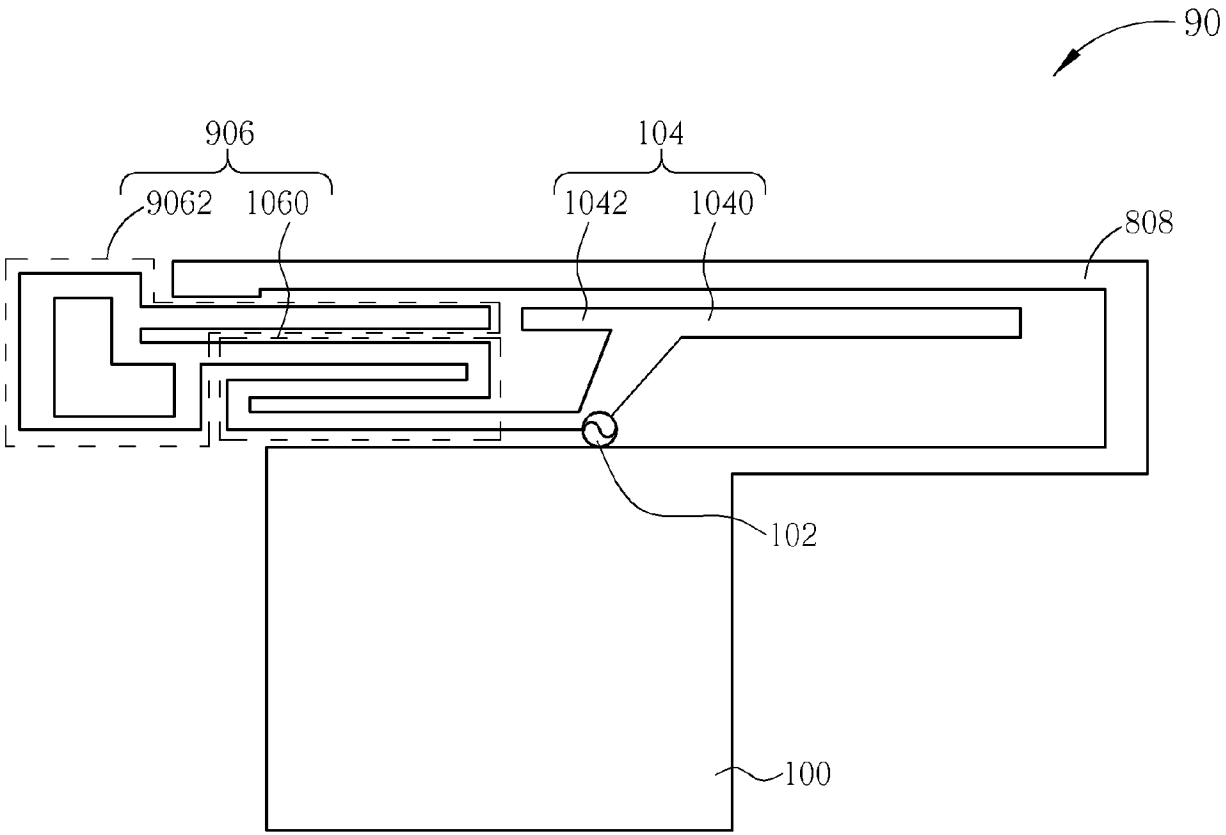
FIG. 9 is a schematic diagram of a wideband antenna according to an embodiment of the present invention.

Both the wideband antenna 40 shown in FIG. 4 and the wideband antenna 10 shown in FIG. 1 use the meander-shaped radiating units and the coupling method, to increase operating bandwidths. Those skilled in the art can make modifications accordingly. For example, please refer to FIG. 7 to FIG. 9, which are schematic diagrams of wideband antennas 70, 80 and 90 according to embodiments of the present invention. The wideband antennas 70, 80 and 90 are similar to the wideband antenna 10; thus, the same units are denoted by the same labels. The differences thereof are shown as follows. Third radiating units 708 and 808 of the wideband antennas 70 and 80 are derived by adjusting the third radiating unit 108 of the wideband antenna 10, and removing the parallel segments. An auxiliary radiating unit 9062 and a corresponding second radiating unit 906 of the wideband antenna 90 are derived by adjusting the auxiliary radiating unit 1062 of the second radiating unit 106 in the wideband antenna 10, to be extending toward the meander-shaped element 1060.

To sum up, the present invention uses the meander-shaped radiating unit and the coupling method, to increase operating bandwidth of the wideband antenna, and maintain antenna efficiency, so as to apply to wireless communication systems with wideband requirements.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A wideband antenna, comprising:

a grounding element;

a feed-in terminal;

a first radiating unit, electrically connected to the feed-in terminal and extending from the feed-in terminal toward a first direction, for transmitting and receiving wireless signals in a first frequency band;

a second radiating unit, electrically connected to the feed-in terminal, extending from the feed-in terminal toward a second direction, and comprising a meander-shaped element, for transmitting and receiving wireless signals in a second frequency band; and a third radiating unit, electrically connected to the grounding element at an end of the third radiating unit, extending from the grounding element toward the first radiating unit and the second radiating unit, and having one segment parallel to the meander-shaped element, for coupling the meander-shaped element, so as to transmit and receive wireless signals in a third frequency band;

wherein a length of the third radiating unit from the end connected to the grounding element to the other end is greater than a length of the first radiating unit, and a long segment of the meander-shaped element is parallel to the second direction.

2. The wideband antenna of claim 1, wherein the first direction is opposite to the second direction.

3. The wideband antenna of claim 2, wherein the third radiating unit has another segment substantially surrounding the first radiating unit and parallel to the first radiating unit.

4. The wideband antenna of claim 1, wherein the meander-shaped element of the second radiating unit is further parallel to a side of the grounding element, for coupling the grounding element.

5. The wideband antenna of claim 1, wherein the second radiating unit further comprises an auxiliary radiating unit, electrically connected to the meander-shaped element and extending from the meander-shaped element toward the second direction.

6. The wideband antenna of claim 5, wherein a horizontal projection result of the auxiliary radiating unit does not overlap the grounding element.

7. The wideband antenna of claim 1, wherein the first radiating unit comprises a first segment and a second segment, and the feed-in terminal is connected between the first segment and the second segment.

* * * * *